United States Patent [19]

Folkins

[11] Patent Number: 4,740,814

[45] Date of Patent: Apr. 26, 1988

[54] PREVIEW SYSTEM FOR AN ELECTROPHOTOGRAPHIC PRINTING MACHINE

[75] Inventor: Jeffrey J. Folkins, Rochester, N.Y.

[73] Assignee: Xerox Corporation, Stamford, Conn.

[21] Appl. No.: 2,042

[22] Filed: Jan. 9, 1987

[51] Int. Cl.[4] ..... G03G 15/00

[52] U.S. Cl. ..... 355/7; 355/5

[58] Field of Search ..... 355/5, 14 R, 7, 8, 11, 355/3 CH

[56] References Cited

U.S. PATENT DOCUMENTS

| | | | |
|---|---|---|---|
| 4,153,364 | 5/1979 | Suzuki et al. | 355/14 |
| 4,239,374 | 12/1980 | Tatsumi et al. | 355/14 |
| 4,375,916 | 3/1983 | Levine | 355/5 |
| 4,435,077 | 3/1984 | Suzuki et al. | 355/5 X |
| 4,616,269 | 10/1986 | Mori | 358/293 |

FOREIGN PATENT DOCUMENTS

| | | | |
|---|---|---|---|
| 3429549 | 2/1985 | Fed. Rep. of Germany . | |
| 0056537 | 5/1977 | Japan | 355/5 |
| 0085063 | 5/1982 | Japan | 355/5 |
| 0067972 | 4/1985 | Japan | 355/5 |
| 60-85676 | 5/1985 | Japan . | |

*Primary Examiner*—R. L. Moses

*Attorney, Agent, or Firm*—H. Fleischer; J. E. Beck; R. Zibelli

[57] ABSTRACT

An electrophotographic printing machine in which an edited copy of an original document is formed. A video image of the original document is displayed and the machine operator adjusts the image as desired. After being adjusted, an edited copy of the video image is reproduced by the printing machine.

18 Claims, 2 Drawing Sheets

PREVIEW SYSTEM FOR AN ELECTROPHOTOGRAPHIC PRINTING MACHINE

Figure 1:
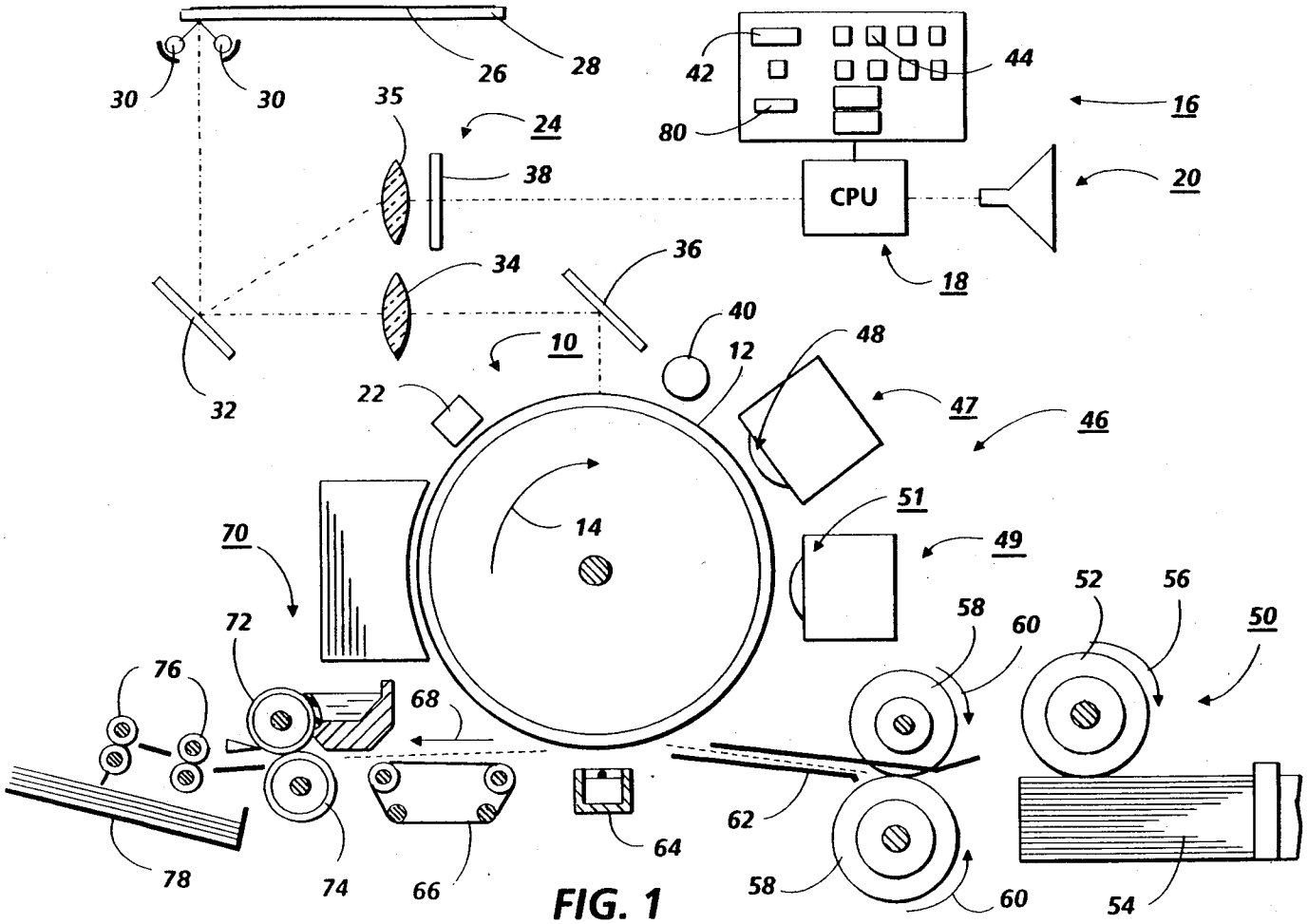

This invention relates generally to an electrophotographic printing machine, and more particularly concerns a system for previewing the copy of the original document being reproduced by the printing machine.

In general, the process of electrophotographic printing includes charging a photoconductive member to a substantially uniform potential to sensitize the surface thereof. The charged portion of the photoconductive surface is exposed to a light image of an original document being reproduced. In this way, an electrostatic latent image is recorded on the photoconductive surface which corresponds to the information desired to be reproduced. After recording the electrostatic latent image on the photoconductive member, the latent image is developed by bringing developer material into contact therewith. Generally, the developer material comprises toner particles adhering triboelectrically to carrier granules. The toner particles are attracted from the carrier granules to form a toner powder image on the photoconductive member which is subsequently transferred to a copy sheet. Finally, the copy sheet is heated to permanently affix the powder image thereto in image configuration.

Recently, it has become desirable to edit the original document being reproduced in the copying machine. This may be greatly facilitated by previewing the resultant copy. Thus, it would be highly desirable to be capable of displaying the copy electronically prior to the actual formation of the hard copy so that the machine operator can perform any desired editing on the electronic copy being displayed. For example, if the copy of the original document is enlarged or reduced, the corresponding electronic image being displayed would also be enlarged or reduced according to the optics enlargement/reduction ratio selected and the size of the copy sheet. Thus, the electronic display of the copy seen by the operator corresponds exactly to the resultant hard copy produced by the printing machine. Similarly, other features may also be displayed electronically. For example, the displayed image could show operator selected image shift. In addition, the result of deleting or adding information could also be shown. Furthermore, the effect of making the copy darker or light may also be displayed. Thus, it is clear that previewing the copy of the original document allows the measurement and adjustment of a number of operating parameters, e.g. contrast, toner consumption, document size and position. Moreover, the ability to preview the copy of the original document permits the effect of the various editing commands, e.g. reduction/enlargement, margin settings, and text deletion/addition to be seen by the machine operator.

Various techniques have been devised to achieve the foregoing. The following disclosures appear to be relevant:

U.S. Pat. No. 4,153,364
Patentee: Suzuki et al.
Issued: May 8, 1979
U.S. Pat. No. 4,239,374
Patentee: Tatsumi et al.
Issued: December 16,1980
U.S. Pat. No. 4,375,916

-continued

Patentee: Levine
Issued: March 8, 1983
U.S. Pat. No. 4,616,269
Patentee: Mori
Issued: October 7, 1986
German OLS DE 3,429,549 A1
Applicant: Yatanade
Published: February 28, 1985
Japanese Patent Appln. No. 60.85676
Applicant: Nishiguchi
Published: May 15, 1985

The pertinent portions of the foregoing disclosures may be briefly summarized as follows:

Susuki et al. and Tatsumi et al. teach the use of photosensors to detect print density and the format on a page. This, in turn, is used to measure various operating parameters within the printing machine, for example, exposure illumination and density, developer bias voltage, etc.

Levine discloses a portable image reader/recorder with a display allowing adjustment of the various parameters. The reader is connected to a compatible electrophotographic printing machine to produce a printout of the recorded image.

Mori describes a technique for optically displaying an original document on a screen to allow the operator to set the margins and various other functions of the copy.

Yatanade discloses a charge coupled device (CCD) array in the optical path of an electrophotographic printing machine to drive a liquid crystal display (LCD display) indicating the size and position of the original document.

Nishiguchi teaches a facsimile device which will display a received image on a screen prior to the printing thereof.

In accordance with one aspect of the features of the present invention, there is provided an electrophotographic printing machine for forming a copy of an original document. The printing machine includes a photoconductive member. Means are provided for charging at least a portion of the photoconductive member. Means sense an optical image and generate an electrical video image in response thereto. Means form a light image of the original document. The forming means projects the light image of the original document onto the sensing means to produce an electrical image thereof and projects the light image of the original document onto the charged portion of the photoconductive member to record an electrostatic latent image of the original document thereon.

Figure 2:
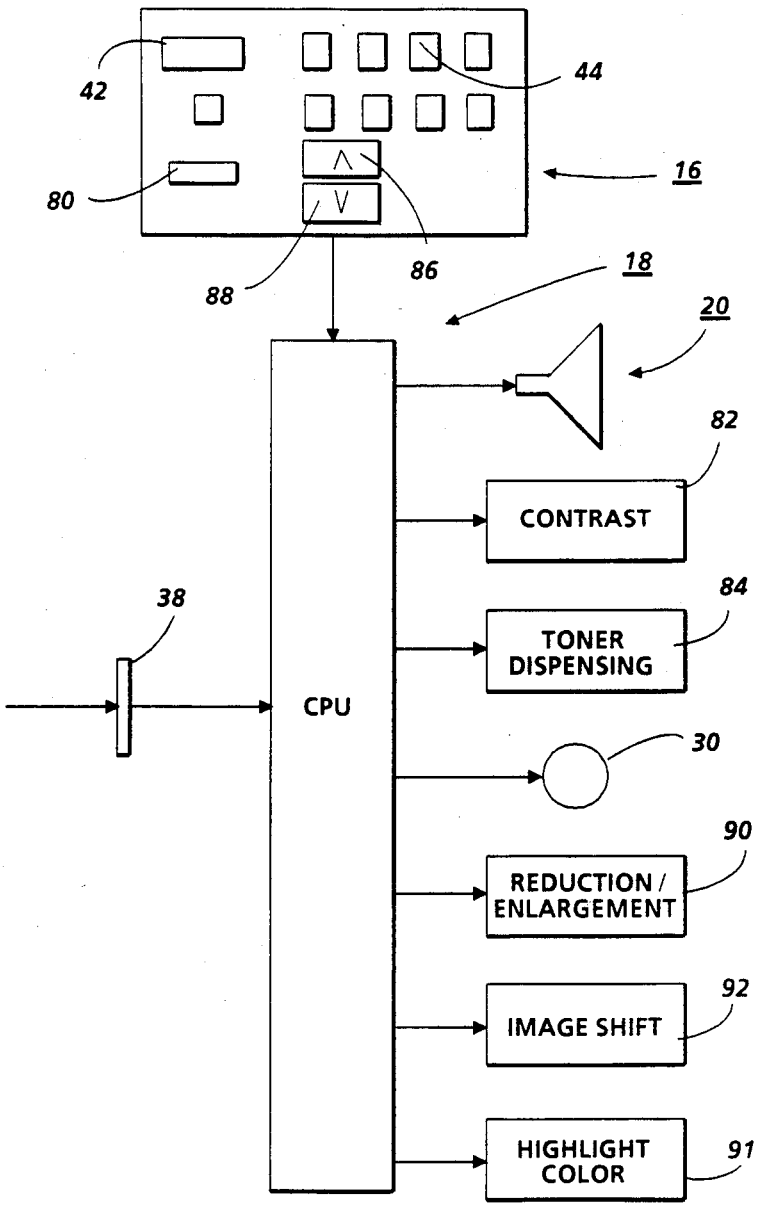

Other aspects of the present invention will become apparent as the following description proceeds and upon reference to the drawings in which:

FIG. 1 is a schematic elevational view showing an electrophotographic printing machine incorporating the features of the present invention therein; and FIG. 2 is a schematic elevational view showing a block diagram of the system for controlling the various parameters of the processing stations in the FIG. 1 electrophotographic printing machine.

While the present invention will hereinafter be described in conjunction with a preferred embodiment thereof, it will be understood that it is not intended to limit the invention to that embodiment. On the contrary, it is is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of an electrophotographic printing machine incorporating the features of the present invention therein. It will become evident from the following discussion that the present invention is not limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a drum 10 having a photoconductive surface 12. Preferably, photoconductive surface 12 is made from a selenium alloy deposited on a conductive substrate, such as an aluminum alloy. Drum 10 moves in the direction of arrow 14 to advance successive portions of photoconductive surface 12 sequentially through the various processing stations disposed about the path of movement thereof.

In operation, the operator may select the number of copies being reproduced as well as being capable of adjusting any of the parameters within the various processing stations. This is achieved by keying in the required adjustment and number of copies at the control panel, indicated generally by the reference numeral 16. Control panel 16 is electrically coupled to a centralized processing unit, indicated generally by the reference numeral 18. Preferably, centralized processing unit (CPU) 18 is a microprocessor made by Intel Corporation under the Model No. 8086. CPU 18 is electrically connected to the various processing stations within the electrophotographic printing machine so as to control their operation. In addition, CPU 18 is electrically coupled to a video display, indicated generally by the reference numeral 20. Display 20 is adapted to display the resultant copy electronically. Thus, Display 20 displays an electrical video image of the resultant copy of the original document. The electrical video image displayed shows the effects of the various manipulations performed thereon by the operator through the utilization of control panel 16. For example, if the operator elects to have an enlarged or reduced copy, the displayed copy will correspond to the desired enlargement or reduction of the original document. Alternatively, if the operator elects to delete selected portions from the original document in the copy, the displayed video image will show the copy with the portions of the original document delected therefrom. Thus, display 20 provides a preview of the resultant copy to the operator prior to the formation of the hard copy thereof.

With continued reference to FIG. 1, initially, a portion of photoconductive surface 12 passes through a charging station. At the charging station, a corona generating device, indicated generally by the reference numeral 22, charges photoconductive surface 12 to a relatively high substantially uniform potential.

Next, the charged portion of photoconductive surface 12 is advanced through an imaging station. The imaging station includes an exposure system, indicated generally by the reference numeral 24. In exposure system 24, an original document 26 is positioned face down on a transparent platen 28. Lamp 30 move across platen 28 to illuminate successive incremental areas of original document 26. The light rays reflected from original document 26 are reflected from mirror 32 through lens 34 and lens 35 to form a light images thereof. The light image transmitted through lens 35 is transmitted to a solid state optical-electrical panel, such as a charged couple device matrix or array (CCD array), indicated generally by the reference numeral 38, or the like. Mirror 32, lens 35, CCD array 38, and lens 34 move in a timed relationship with lamps 34 so as to be in the proper relationship with respect thereto for forming the light image. Mirror 36 is positioned in the light path of the light image transmitted through lens 36. The light image transmitted through lens 34 is reflected by mirror 36 onto the charged portion of photoconductive surface 12 to record an electrostatic latent image thereon corresponding to the original document. In order to preview the copy, CCD array 38, in response to the light image transmitted thereto through lens 35 generates an electrical video image corresponding to the original document. CCD array 38 is electrically coupled to CPU 18. CPU 18, in turn, is connected electrically to control panel 16. The operator selects the variations desired in the copy through the use of control panel 16 which, in turn, transmits electrical signals indicative thereof to CPU 18. CPU 18 adjusts the electrical video image transmitted from CCD array 38 to correspond with the changes transmitted thereto from control panel 16. The adjusted electrical video image is then transmitted from CPU 18 to display 20, which may be a cathode ray tube (CRT) or a liquid crystal display. CRT 20 displays the desired copy. Prior to the operator performing any control function through the utilization of control panel 16, CRT 20 displays the un-adjusted copy which corresponds to the original document as it will be reproduced After the operator introduces the desired adjustments to the original document, CRT 20 displays the adjusted copy thereon. CPU 18 is also electrically connected to the various processing stations in the printing machine. In this way, CPU 18 controls these processing stations to produce the operator selected adjustments to the copy of the original document.

In the copying mode, the electrostatic latent image is recorded on the photoconductive surface. This is achieved by mirror 36 positioned in the path of the light image transmitted from lens 34 so as to reflect the light image of the original document onto the charged portion of photoconductive surface 12. The region between successive electrostatic latent images and the lateral marginal regions of the electrostatic latent image are discharged by erase lamp 40. Erase lamp 40 also acts to delete selected portions of the electrostatic latent image in response to the appropriate command from the CPU 18. Erase lamp 40 comprises a plurality small lamps which may be independently energized to eliminate selected portions of the electrostatic latent image recorded on photoconductive surface or any charged portion of photoconductive surface 12. Alternatively, erase lamp 40 may be made from a plurality of light emitting diodes (LEDs). The lamps of erase lamp 40 extend across the width of drum 10 in a direction substantially parallel to the longitudinal axis thereof. Erase lamp 40 is electrically connected to CPU 18. In order to delete selected portions of the original document in the copy, the operator, through the use of control panel 16, defines the coordinates or portions of the original document to be deleted from the copy. As previously indicated, in the preview mode of operation, the original document is displayed on CRT 20. CRT 20 has X and Y axes or scales thereon. Thus, the operator can readily determine the coordinates of the portion of the original document to be deleted. On control panel 16, the operator presses edit key 42 to place control panel 16 in the edit mode of operation. Thereafter, the operator depresses numeral keys 44 to define the X and Y coordinates of the portion of the original document to be delected from the copy. Electrical signals from numeral keys 44 corresponding to the coordinates of the original document to be deleted from the copy are transmitted to CPU 18. This information is used to control the selective, independent energization of the lamps which make up erase lamp 40. This defines the duration of time that each of the erase lamps 40 are energized. Thus, the selected lamps are turned on at the appropriate time to delete the desired portion of the electrostatic latent image so that the resultant copy has the selected portion of the original document deleted therefrom. Furthermore, the individual lamps of erase lamp 40 are energized to discharge the region between electrostatic latent images, i.e. the inter-image region. In addition, side lamps are continuously energized to discharge the lateral marginal region of the drum outside the area of the electrostatic latent image on the side portions thereof. One skilled in the art will appreciate that the input of the coordinates to be deleted is not limited to keys. Cursor and other position appointing members may be used for the same purpose. If it is desired to form a color highlighted copy, the portion to be reproduced in the highlight color is deleted in accordance with the preceeding procedure to form a first edited electrostatic latent image. A second electrostatic latent image of the original document has the other portion, i.e. the area to be reproduced in black, deleted therefrom to form a second electrostatic latent image. The edited electrostatic latent image is advanced on drum 10 to development station C.

At the development station C, a magnetic brush development system, indicated generally by the reference numeral 46, includes a first developer unit, indicated generally by the reference numeral 47, and a second developer unit, indicated generally by the reference numeral 49. Developer unit 47 is adapted to develop the electrostatic latent image with black toner particles while developer unit 49 is adapted to develop the electrostatic latent image with toner particles of a color other than black, e.g. red. Developer unit 47 includes at least one developer roller, indicated generally by reference numeral 48, for transporting a developer material of carrier granules having toner particles adhering triboelectrically thereto into contact with the electrostatic latent image. Developer roller 48 is made from a non-magnetic sleeve having a stationary magnetic disposed interiorly thereof. The non-magnetic sleeve is electrically biased. As the non-magnetic sleeve rotates, the developer material is attracted thereto and transported into contact with the electrostatic latent image recorded on photoconductive surface 12. The exterior circumferential surface of the non-magnetic sleeve is roughened. By way of example, the non-magnetic sleeve is made preferably from aluminum with the magnet being made from barium ferrite. A voltage source is coupled to the non-magnetic sleeve. The output from the voltage source is controlled by the CPU 18. Thus, CPU 18 is electrically coupled to the voltage source which regulates the electrical bias on the non-magnetic sleeve of developer roller 48. Developer unit 49 includes at least one developer roller, indicated generally by reference numeral 51, for transporting a developer material of carrier granules having toner particles adhering triboelectrically thereto into contact with the electrostatic latent image. Developer roller 51 is made from a non-magnetic sleeve having a stationary magnetic disposed interiorly thereof. The non-magnetic sleeve is electrically biased. As the non-magnetic sleeve rotates, the developer material is attracted thereto and transported into contact with the electrostatic latent image recorded on photoconductive surface 12. The exterior circumferential surface of the non-magnetic sleeve is roughened. By way of example, the non-magnetic sleeve is made preferably from aluminum with the magnet being made from barium ferrite. A voltage source is coupled to the non-magnetic sleeve. The output from the voltage source is controlled by the CPU 18. Thus, CPU 18 is electrically coupled to the voltage source which regulates the electrical bias on the non-magnetic sleeve of developer roller 51. CPU 18 controls the energization of either developer unit 47 or developer unit 49 to develop the electrostatic latent image. The developer units are move from a position remote from the photoconductive surface to an operative position adjacent thereto. In the preview mode of operation, the operator may actuate the appropriate key on control panel 16 to adjust the contrast of the copy. Thus, the copy may be made darker or lighter. This is achieved by adjusting the electrical bias on developer roller 48. Hence, the operator selects the appropriate key, i.e. the darker or lighter key, and the voltage source coupled to developer roller 48 is adjusted so as to set the electrical bias on the developer roller at the desired level. Alternatively, copy contrast may be adjusted by regulating the intensity of the exposure lamps 30 or the charge level produced by corona generating device 22.

After development, drum 10 advances the toner powder image to the transfer station. At the transfer station, a sheet of support material is moved into contact with the powder image. The sheet of support material is advanced to transfer station D by a sheet feeding apparatus, indicated generally by the reference numeral 50. Preferably, sheet feeding apparatus 50 includes a feed roll 52 contacting the uppermost sheet of a stack of sheets 54. Feed roll 52 rotates in the direction of arrow 56 so as to advance the uppermost sheet into the nip defined by forwarding rollers 58. Forwarding rollers 58 rotate in the direction of arrow 60 to transport the sheet into chute 62. Chute 62 directs the advancing sheet of support material into contact with photoconductive surface 12 of drum 10 so that the toner powder image developed thereon contacts the advancing sheet at the transfer station.

Preferably, the transfer station includes a corona generating device 64 which sprays ions onto the backside of the sheet. This attracts the toner powder image from photoconductive surface 12 to the sheet. After transfer, the sheet continues to move on conveyor 66, in the direction of arrow 68, to fusing station E.

Fusing station E includes a fuser assembly, indicated generally by the reference numeral 70 which permanently affixes the transferred toner powder image to the sheet. Preferably, fuser assembly 70 includes a heated fuser roller 72 and a back-up roller 74. The sheet passes between fuser roller 72 and back-up roller 74 with the powder image contacting fuser roller 72. In this manner, the powder image is permanently affixed to the sheet. After fusing, forwarding rollers 76 advance the sheet to catch tray 78 for subsequent removal from the printing machine by the operator. If a color highlight copy is being produced, the sheet is recirculated to the transfer station so that the next toner powder image may be transferred thereto. Thereafter, the sheet passes through the fusing station to permanently affix this powder image thereto and the resultant highlight color copy advances to catch tray 78.

After the powder image is transferred from photoconductive surface 12 to the copy sheet, drum 10 rotates the photoconductive surface to cleaning station F. At cleaning station F, a magnetic brush cleaning system removes the residual particles adhering to photoconductive surface 12. The magnetic rush cleaning system transports carrier granules closely adjacent to the photoconductive surface to attract residual toner particles thereto. In this way, the residual particles are removed from photoconductive surface 12 prior to initiation of the next successive imaging cycle.

It is believed that the foregoing description is sufficient for purposes of the present invention to illustrate the operation of an electrophotographic printing machine incorporating the features of the present invention therein. Referring now to FIG. 2, the details of the control scheme associated with the capability to preview the resultant copy will be discussed.

As shown in FIG. 2, if the operator desires to edit the copy of the original document, edit key 42 of control panel 16 is depressed. Thereafter, the operator selects the appropriate keys 44 which are numeral keys for inputting the coordinates of the portion of the original document to be deleted from the copy. As previously indicated, the unedited original document is displayed on CRT 20. Scales on CRT 20 enable the operator to readily select the coordinates of the portion of the copy to be deleted. The operator now depresses the appropriate numeral keys 44 to define these coordinates. This information is then transmitted electrically from control panel 16 to CPU 18. CPU 18, in turn, now energizes the appropriate lamps of erase lamp 40 so as to effect the desired deletion from the electrostatic latent image recorded on photoconductive surface 12 of drum 10. The electrostatic latent image is recorded on photoconductive surface 12 of drum 10 by the operator by depressing key 80 which switches the copying machine from the previewing or editing mode to the copying mode. As previously noted, CCD array 38 transmits an electrical video signal to CPU 18 which, in turn, energizes CRT 20 to display the original document thereon. As the operator affects adjustments, these adjustments are displayed on CRT 20 so that the resultant video image corresponds substantially to the resultant copy that will be reproduced by the electrophotographic printing machine. As shown in FIG. 2, CCD array 38 transmits the electrical video signal to CPU 18 which, in turn, generates an adjusted electrical video signal to CRT 16 for display. If the copy contrast is desired to be changed, the operator will selected the appropriate key to either increase or decrease the copy contrast. A signal is transmitted from control panel 16 to CPU 18. CPU 18, in turn, adjusts the voltage source of the bias control system, indicated generally by the reference numeral 82. This increases or decreases the electrical bias of either developer roller 48, lamps 30, or corona generator 22. In addition to controlling the contrast of the copy, CPU 18 also regulates toner dispensing as a function of the percentage of area requiring writing thereon. Thus, the CCD array 38 transmits an electrical video image of the original document to CPU 18. Control panel 16 transmits the operator selected adjustments to CPU 18. CPU 18 generates an electrical signal corresponding to the adjusted copy. CPU 18 determines the percentage of the adjusted copy that will require toner particles. In this way, the centralized processing unit regulates dispensing of toner particles from a toner hopper into the sump of developer units 47 and 49. The centralized processing unit will control the electrical circuit and motor associated with rotating a foam roller in the opening of the toner hopper of each of the developer units to discharge toner particles therefrom into the sump of developer unit. Thus, CPU 18 controls toner dispensing control circuit 84 to regulate the concentration of toner particles within the developer units. This maintains the concentration of toner particles within the developer mixture, i.e. the ratio of toner particles to carrier granules substantially constant. The details of this type of toner dispensing system are described in co-pending U.S. patent application Ser. No. 925,578 filed on Oct. 31, 1986, the relevant portions thereof being hereby incorporated into the present application. One skilled in the art will appreciate that many other types of control schemes may be employed to regulate the discharge of toner particles under the control of CPU 18.

If it is desired to adjust the magnification of the copy, the operator depresses key 86 or 88 to either enlarge or reduce the resultant copy. This results in an electrical signal being transmitted from control panel 16 to CPU 18 indicating the required enlargement/reduction. CPU 18, in turn, controls reduction/enlargement control circuit 90 to regulate exposure system 24 to effect the desired enlargement or reduction of the original document on the copy. In the preview mode of operation, CRT 20 displays the resultant adjusted copy having the selected enlargement or reduction.

Still another adjustment may be to shift the image on the copy sheet sideways, i.e. so as to produce a desired side margin, for example, to punch holes in the copy sheet or to facilitate binding or stapling a stack of sheets to one another. The image shift control circuit 92 is also controlled by CPU 18. The operator selects the appropriate key on control panel 16 and transmits and electrical signal to CPU 18 indicating that an image shift should be affected. Centralized processing unit 18, in turn, regulates image shift control circuit 92 which, in turn, controls exposure system 24 to effect the desired shift of the image. Once again, in the previewing mode, the shift of the image on the copy sheet is displayed on the cathode ray tube.

A further application of the present invention includes the addition of text to the copy. This may be achieved by a printing machine including a laser system for writing on the charged photoconductive surface. A keyboard coupled to CPU 18k generates the desired text. CPU 18, in turn, transmits electrical signals to CRT 20 to display the text on the video image of the copy. Thus, the operator may now view the final copy with the text added thereto. CPU 18 also modulates the laser system to write the text on the charged photoconductive surface forming an electrostatic latent image thereof. The latent image is developed and the added test transferred to the copy sheet having the desired information from the original document thereon. In this way, editing includes adding information e.g. text, as well as adjusting the parameters of the copy, and producing highlight color copies, or any other variations or changes to the copy of the original document.

It is clear that the centralized processing unit may be utilized to control any of the various processing stations within the electrophotographic printing machine. Thus, in the adjustment stage, the operator selects the desired adjustment on control panel 16. Control panel 16 transmits an electrical signal corresponding to the required change to CPU 18. CPU 18, in turn, regulates the appropriate processing station to effect the desired adjustment to the copy. The adjustment to the copy is displayed to the operator on the cathode ray tube.

After the operator has affected the desired changes, copying key 80 is depressed. Thereafter, the operator selects numeral keys 42 to specify the number of edited copies to be reproduced. Thus, the electrophotographic printing machine will reproduce the requisite number of edited copies. For example, if the operator desires five copies having a portion of the original document deleted therefrom, after selecting editing button 42 and defining the coordinates of the portion of the original document to be deleted, the operator selects copying key 80 and, thereafter, the numeral key 44 corresponding to the desired number of copies. This actuates the electrophotographic printing machine to produce the desired number of copies which have the selected portion of the original document deleted therefrom.

In recapitulation, it is evident that an electrophotographic printing machine having the features of the present invention incorporated therein is capable of operating in both a preview mode and a copying mode. In the previewing mode of operation, the operator is initially shown a display of the unadjusted copy of the original document. The operator then actuates the appropriate keys on the control panel to edit the copy. The edited copy is now displayed to the operator. When the operator is satisfied with the edited copy, the appropriate copying key is energized on the control panel so that the printing machine is switched to the copying mode of operation. The operator now selects the number of copies to be reproduced and the machine is actuated to reproduce the desired number of edited copies.

It is evident, that there has been provided in accordance with the present invention an electrophotographic printing machine that fully satisfies the aims and advantages hereinbefore set forth. While this invention has been described in conjunction with a preferred embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An electrophotographic printing machine for forming an edited copy of an original document, including:

a photoconductive member;

means for charging at least a portion of said photoconductive member;

means for sensing an optical image and generating an electrical video image in response thereto;

means for forming a light image of the original document, said forming means projecting the light image of the original document onto said sensing means to produce an electrical video image thereof, and said forming means projecting the light image of the original document onto the charged portion of said photoconductive member to record an electrostatic latent image of the original document thereon;

means for editing the electrostatic latent image by adding or deleting information from the electrostatic latent image so that the copy differs from the original document; and means, operatively associated with said sensing means, for displaying the electrical video image of the edited original document to provide a preview of the edited copy.

2. A printing machine according to claim 1, further including means for depositing marking particles on the electrostatic latent image to form a powder image on said photoconductive member.

3. An electrophotographic printing machine for forming an edited copy of an original document, including:

a photoconductive member;

means for charging at least a portion of said photoconductive member;

means for sensing an optical image and generating an electrical video image in response thereto;

means for forming a light image of the original document, said forming means projecting the light image of the original document onto said sensing means to produce an electrical video image thereof, and said forming means projecting the light image of the original document onto the charged portion of said photoconductive member to record an electrostatic latent image of the original document thereon;

means, operatively associated with said sensing means, for displaying the electrical video image;

means for editing the electrostatic latent image so that the copy differs from the original document;

means for depositing marking particles on the electrostatic latent image to form a powder image on said photoconductive member; and means, operatively associated with said sensing means, for controlling said depositing means to regulate the contrast of the copy formed in the printing machine.

4. A printing machine according to claim 3, further including means for dispensing marking particles into said depositing means.

5. A printing machine according to claim 4, further including means, operatively associated with said sensing means, for regulating said dispensing means to regulate the discharge of marking particles into said depositing means.

6. An electrophotographic printing machine for forming an edited copy of an original document including:

a photoconductive member;

means for charging at least a portion of said photoconductive member;

means for sensing an optical image and generating an electrical video image in response thereto;

means for forming a light image of the original document, said forming means projecting the light image of the original document onto said sensing means to produce an electrical video image thereof, and said forming means projecting the light image of the original document onto the charged portion of said photoconductive member to record an electrostatic latent image of the original document thereon;

means, operatively associated with said sensing means, for displaying the electrical video image;

means for editing the electrostatic latent image so that the copy differs from the original document; and means, operatively associated with said editing means, for controlling said charging means to regulate the voltage level on said photoconductive member, thereby adjusting the contrast of the copy formed by the printing machine.

7. An electrophotographic printing machine for forming an edited copy of an original document, including:

a photoconductive member;

means for charging at least a portion of said photoconductive member;

means for sensing an optical image and generating an electrical video image in response thereto;

means for forming a light image of the original document, said forming means projecting the light image of the original document onto said sensing means to produce an electrical video image thereof, and said forming means projecting the light image of the original document onto the charged portion of said photoconductive member to record an electrostatic latent image of the original document thereon;

means, operatively associated with said sensing means, for displaying the electrical video image;

means for editing the electrostatic latent image so that the copy differs from the original document; and means, operatively associated with said editing means, for controlling said forming means to regulate the intensity of the light image projected onto the charged portion of said photoconductive member, thereby adjusting the contrast of the copy formed in the printing machine.

8. A printing machine according to claim 7, further including means, operatively associated with said editing means, for controlling said forming means to regulate the size of the light image projected onto the charged portion of said photoconductive member, thereby adjusting the magnification of the copy formed in the printing machine.

9. An electrophotographic printing machine for forming an edited copy of an original document including:

a photoconductive member;

means for charging at least a portion of said photoconductive member;

means for sensing an optical image and generating an electrical video image in response thereto;

means for forming a light image of the original document, said forming means projecting the light image of the original document onto said sensing means to produce an electrical video image thereof, and said forming means projecting the light image of the original document onto the charged portion of said photoconductive member to record an electrostatic latent image of the original document thereon;

means, operatively associated with said sensing means, for displaying the electrical video image;

means for editing the electrostatic latent image so that the copy differs from the original document; and means, operatively associated with said editing means, for controlling said forming means to regulate the position of the light image projected onto the charged portion of said photoconductive member, thereby adjusting the shift of the image reproduced on the copy by the printing machine.

10. An electrophotographic printing machine for forming an edited copy of an original document, including:

a photoconductive member;

means for charging at least a portion of said photoconductive member;

means for sensing an optical image and generating an electrical video image in response thereto;

means for forming a light image of the original document, said forming means projecting the light image of the original document onto said sensing means to produce an electrical video image thereof, and said forming means projecting the light image of the original document onto the charged portion of said photoconductive member to record an electrostatic latent image of the original document thereon;

means, operatively associated with said sensing means, for displaying the electrical video image;

means for editing the electrostatic latent image so that the copy differs from the original document;

means for depositing marking particles on the electrostatic latent image to form a powder image on said photoconductive member; and means, operatively associated with said editing means, for deleting selected areas of the electrostatic latent image recorded on said photoconductive member.

11. A printing machine according to claim 10, wherein forming means projects at least two light images of the original document onto the charged portion of said photoconductive member to record a first electrostatic latent image and a second electrostatic latent image on said photoconductive member.

12. A printing machine according to claim 11, wherein said deleting means deletes one region from the first electrostatic latent image recorded on said photoconductive member to form a first edited electrostatic latent image and the other region from the second electrostatic latent image recorded on said photoconductive member to form a second edited electrostatic latent image.

13. A printing machine according to claim 12, wherein said depositing means develops the first edited electrostatic latent image with marking particles of a first color and said depositing means develops the second edited electrostatic latent image with marking particles of a second color different from the first color.

14. A printing machine according to claim 10, wherein said sensing means includes at least a charge coupled device.

15. A printing machine according to claim 14, wherein said displaying means includes at least a cathode ray tube.

16. A printing machine according to claim 14, wherein said displaying means includes at least a liquid crystal display.

17. A printing machine according to claim 10, further including a plurality of processing stations for assisting in producing the copy of the original document from the electrostatic latent image recorded on said photoconductive member.

18. A printing machine according to claim 17, further including, means for controlling at least one of said plurality of processing stations to produce an adjusted copy of the original document.

* * * * *